US005552020A

United States Patent [19]

Smith et al.

[11] Patent Number: 5,552,020

[45] Date of Patent: Sep. 3, 1996

[54] TISSUE PRODUCTS CONTAINING SOFTENERS AND SILICONE GLYCOL

[75] Inventors: Michael J. Smith, Neenah; Wen Z. Schroeder; Gary L. Shanklin, both of Appleton, all of Wis.

[73] Assignee: Kimberly-Clark Corporation, Neenah, Wis.

[21] Appl. No.: 505,839

[22] Filed: Jul. 21, 1995

[51] Int. Cl.[6] ..... D21H 17/13

[52] U.S. Cl. ..... 162/164.4; 162/158; 162/179

[58] Field of Search ..... 162/158, 179, 162/164.4, 111, 112; 428/153, 154

[56] References Cited

U.S. PATENT DOCUMENTS

| | | | |
|---|---|---|---|
| 22,362 | 12/1858 | Glynn | 167/84 |
| 302,073 | 7/1884 | Wheeler | 167/84 |
| 967,688 | 8/1910 | Titherley | 167/84 |
| 2,251,328 | 5/1938 | Ehret | 252/134 |
| 2,845,454 | 7/1958 | Buckler et al. | 162/158 X |
| 2,926,116 | 2/1960 | Keim | 162/164 |
| 3,058,873 | 10/1962 | Keim | 162/164 |
| 3,138,533 | 6/1964 | Heim et al. | 167/84 |
| 3,227,614 | 1/1966 | Scheur | 167/84 |
| 3,264,188 | 8/1966 | Gresham | 167/84 |
| 3,489,148 | 12/1966 | Duncan et al. | 128/284 |
| 3,499,823 | 3/1970 | Croon et al. | 162/158 |
| 3,585,998 | 6/1971 | Hayford et al. | 128/284 |
| 3,814,096 | 6/1974 | Weiss et al. | 128/268 |
| 3,896,807 | 7/1975 | Buchalter | 128/261 |
| 4,112,167 | 9/1978 | Dake et al. | 428/154 |
| 4,117,187 | 9/1978 | Adams et al. | 428/286 |
| 4,300,981 | 11/1981 | Carstens | 162/109 |
| 4,432,834 | 2/1984 | Whitfield et al. | 162/158 |
| 4,441,962 | 4/1984 | Osborn, III | 162/158 |
| 4,448,638 | 5/1984 | Klowak | 162/158 |
| 4,482,429 | 11/1984 | Klowak | 162/158 |
| 4,528,316 | 7/1985 | Soerens | 524/503 |
| 4,550,035 | 10/1985 | Smith | 427/308.1 |
| 4,555,157 | 12/1985 | Smith et al. | 252/90 |
| 4,560,599 | 12/1985 | Regen | 428/36 |
| 4,613,447 | 9/1986 | Hara et al. | 252/91 |
| 4,615,937 | 10/1986 | Bouchette | 428/288 |
| 4,623,339 | 11/1986 | Ciraldo | 128/287 |
| 4,725,489 | 2/1988 | Jones et al. | 428/289 |
| 4,735,860 | 4/1988 | Mizobuchi et al. | 428/423.1 |
| 4,766,015 | 8/1988 | Nikoloff et al. | 427/326 |
| 4,795,530 | 1/1989 | Soerens et al. | 162/111 |
| 4,817,790 | 4/1989 | Porut et al. | 206/205 |
| 4,883,475 | 11/1989 | Bogart et al. | 604/290 |
| 4,904,524 | 2/1990 | Yoh | 428/311.3 |
| 4,943,350 | 7/1990 | Bogart et al. | 162/158 |
| 5,093,452 | 3/1992 | O'Lenick, Jr. | 528/25 |
| 5,152,928 | 10/1992 | Kudo et al. | 252/351 |
| 5,160,450 | 11/1992 | Okahara et al. | 252/174.21 |
| 5,164,522 | 11/1992 | McCarthy et al. | 554/39 |
| 5,217,576 | 6/1993 | Van Phan | 162/158 |
| 5,237,035 | 8/1993 | O'Lenick, Jr. et al. | 528/27 |
| 5,240,562 | 8/1993 | Van Phan et al. | 162/158 |
| 5,334,286 | 8/1994 | Van Phan et al. | 162/158 |
| 5,352,817 | 10/1994 | McCarthy et al. | 556/423 |
| 5,399,241 | 3/1995 | Oriaran et al. | 162/112 |

FOREIGN PATENT DOCUMENTS

| | | |
|---|---|---|
| 866298 | 8/1978 | Benelux TM/Des. Off. . |
| 116512A | 8/1984 | European Pat. Off. . |
| 132128A | 1/1985 | European Pat. Off. . |
| 1118781 | 12/1961 | Germany . |
| 024811A | 2/1987 | Germany . |
| 63-023976 | 1/1988 | Japan . |
| 406016684 | 1/1994 | Japan . |
| 406136128 | 5/1994 | Japan . |
| 1407134 | 9/1975 | United Kingdom . |
| 2033751 | 5/1980 | United Kingdom . |
| WO9405720 | 9/1993 | WIPO . |

OTHER PUBLICATIONS

Imperante, J., O'Lenick, Jr., A. and Hannon, J. *Silicone Phosphobetaines,* Cosmetics & Toiletries, vol. 190, Mar. 1994, pp. 81–86.

Beran, R. L., *The Evaluation and Selection of Forming Fabrics,* TAPPI, vol. 62, No. 4, Apr. 1979, pp. 39–44.

*Primary Examiner*—Donald E. Czaja
*Assistant Examiner*—Jose A. Fortuna
*Attorney, Agent, or Firm*—Gregory E. Croft

[57] ABSTRACT

Tissue products having improved bulk and softness are made by adding one or more softeners/debonders and a silicone glycol copolymer of the papermaking fibers at the wet end of the tissue machine, prior to the formation of the tissue web. Suitable softeners/debonders include organoreactive polysiloxanes, quaternary ammonium compounds, quaternized protein compounds, phospholipids, and silicone quaternaries.

20 Claims, No Drawings

TISSUE PRODUCTS CONTAINING SOFTENERS AND SILICONE GLYCOL

BACKGROUND OF THE INVENTION

In the fields of facial and bath tissues, efforts are continually being made to improve upon the various properties of the tissues in order to provide better products for the consumer. Among the tissue properties constantly sought to be improved is softness.

Hence there is a need for new methods for increasing the softness of tissue products.

SUMMARY OF THE INVENTION

It has now been discovered that bulk and exceptional softness can be imparted to tissues by incorporating into the tissue a combination of a silicone glycol with one or more softener/debonders. As used herein, "softener/debonders" are chemical compounds selected from the group consisting of quaternary ammonium compounds, quaternized protein compounds, phospholipids, silicone quaternaries and organoreactive polysiloxanes, all hereinafter further described. More specifically, it has been found that the presence of quaternary softener/debonders enhance the effectiveness of the silicone glycol by increasing the retention of the silicone glycol on the fibers.

Hence, in one aspect, the invention resides in a soft tissue comprising papermaking fibers and from about 0.01 to about 6 percent active matter, based on the weight of the fiber, of one or more softeners/debonders selected from the group consisting of quaternary ammonium compounds, quaternized protein compounds, phospholipids, silicone quaternaries and organoreactive polysiloxanes, and from about 0.0001 to about 3 percent active matter, based on the weight of the fiber, of silicone glycol. More specifically, the amount of the softener/debonder can be from about 0.1 to about 3 percent active matter, based on the weight of the fiber, and the amount of silicone glycol can be from about 0.005 to about 1 percent active matter, based on the weight of the fiber.

In another aspect, the invention resides in a method for making a soft tissue comprising: (a) adding one or more softener/debonders and a silicone glycol to an aqueous suspension of papermaking fibers, either separately or as a combined aqueous mixture, wherein the amount of softener/debonder is from about 0.01 to about 6 percent active matter, based on the weight of fiber, more specifically from about 0.1 to about 3 percent active matter, based on the weight of fiber, and wherein the amount of silicone glycol is from about 0.0001 to about 3 percent active matter, based on the weight of fiber, more specifically from about 0.005 to about 1 percent active matter, based on the weight of fiber; (b) depositing the aqueous suspension of papermaking fibers onto a forming fabric to form a tissue web; and (c) dewatering and drying the web. The amount of the silicone glycol and the softener/debonder added will depend largely on the extent to which the silicone glycol and the softener/debonder are retained by the fibers, rather than passing through the system with the water, and the costs of the materials. Suitable silicone glycols include, without limitation, those having the following structure:

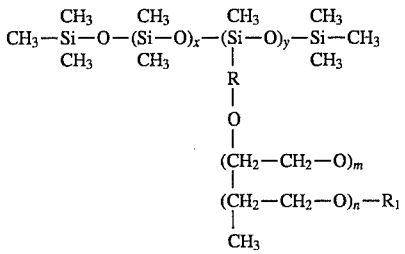

wherein

R=alkyl group, $C_1$–$C_6$;

$R_1$=acetate or hydroxyl group;

x=1 to 1000;

y=1 to 50;

m=1 to 30; and n=1 to 30.

In addition to the silicone glycols, other nonionic surfactants can also be added to the tissue. Examples of useful classes of nonionic surfactants include alkylphenol ethoxylates; aliphatic alcohol ethoxylates (the alkyl chain of the aliphatic alcohol may be either straight or branched, primary or secondary); fatty acid alkoxylates (the fatty acids may be saturated or unsaturated); fatty alcohol alkoxylates; block copolymers of ethylene oxide and propylene oxide; condensation products of ethylene oxide with the product resulting from the reaction of propylene oxide and ethylenediamine; condensation products of propylene oxide with the product of the reaction of ethylene oxide and ethylenediamine; semipolar nonionic surfactants, including water soluble amine oxides; alkylpolysaccharides, including alkylpolyglycosides; and fatty acid amide surfactants.

Also, in addition to the silicone glycol and other nonionic surfactants, polyhydroxy compounds can also advantageously be included. Examples of useful polyhydroxy compounds include glycerol, and polyethylene glycols and polypropylene glycols having a weight average molecular weight of from about 200 to about 4,000, preferably from about 200 to about 1,000, most preferably from about 200 to about 600. Polyethylene glycols having a weight average molecular weight from about 200 to about 600 are especially preferred.

Suitable quaternary ammonium compounds include, without limitation, those having the following structures:

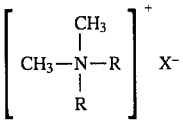

wherein

X=chloride, methyl sulfate, or other compatible counterion; and

R=aliphatic, saturated or unsaturated $C_8$–$C_{22}$;

and

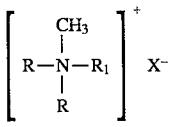

wherein

X=chloride, methyl sulfate, or other compatible counterion;

R=aliphatic, saturated or unsaturated $C_8$–$C_{22}$; and $R_1$=benzyl or epoxy group;

and

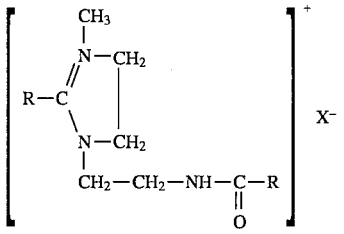

wherein

X=chloride, methyl sulfate, or other compatible counterion; and

R=aliphatic, saturated or unsaturated $C_8$–$C_{22}$;

and

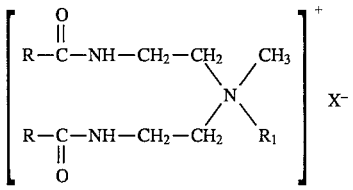

wherein

X=methyl sulfate, chloride, or other compatible counterion;

R=aliphatic, normal, saturated or unsaturated, $C_8$–$C_{22}$; and $R_1$=2-hydroxyethyl or 2-hydroxypropyl;

and

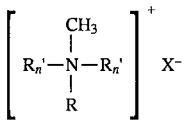

wherein

R=aliphatic, normal or branched, saturated or unsaturated, $C_8$–$C_{22}$;

X=chloride, methyl sulfate, ethyl sulfate, or other compatible counterion;

R'=2-hydroxyethyl or polyethoxyethanol; and n=1 to 50;

and

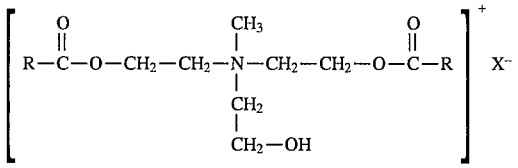

wherein

R=$C_8$–$C_{22}$; and

X=methyl sulfate, chloride, or other compatible counterion;

and

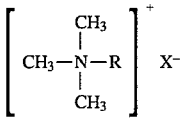

wherein

R=aliphatic, saturated or unsaturated, $C_8$–$C_{22}$; or allyl-; or R'—O—$CH_2$—$CH_2$—$CH_2$— where R'=normal or branched, $C_4$–$C_{18}$; and X=chloride, sulfate or any other compatible counterion;

and

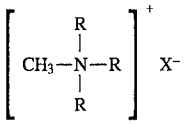

wherein

R=aliphatic alkyl, normal or branched, saturated or unsaturated, $C_8$–$C_{22}$; and X=chloride, methyl sulfate, or other compatible counterion.

Suitable quaternized protein compounds include, without limitation, those having the following structures:

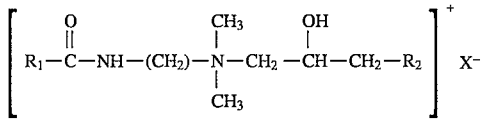

wherein $R_1$=fatty acid radical, saturated or unsaturated, $C_{12}$–$C_{22}$;

$R_2$=hydrolyzed soy protein, hydrolyzed silk protein, collagen, keratin moiety, or hydrolyzed wheat protein; and X=chloride, lactate, or other compatible counterion;

and

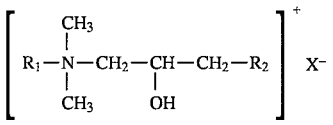

wherein $R_1$=fatty acid radical, saturated or unsaturated, $C_{12}$–$C_{22}$;

$R_2$=hydrolyzed collagen or keratin moiety;

X=chloride, lactate, or other compatible counterion.

Suitable phospholipids include, without limitation, those having the following structures:

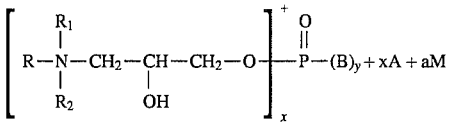

wherein x=1 to 3;

x+y=3;

a=0 to 2;

B=$O^-$ or OM;

A=an anion;

M=a cation; and

R, $R_1$ & $R_2$ can be the same or different, are alkyl, substituted alkyl, alkyl aryl or alkenyl groups of up to 16 carbon atoms and the total carbon atoms of $R+R_1+R_2$=10 to 24;

and

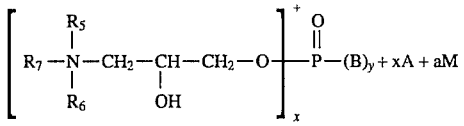

wherein x=1 to 3;

x+y=3;

a=0 to 2;

B=$O^-$ or OM;

A=an anion;

M=a cation;

$R_5$, $R_6$ may be the same or different, are alkyl, hydroxyalkyl, carboxyalkyl of up to $C_6$, or polyoxyalkylene of up to $C_{10}$; or $R_5$, $R_6$ and the nitrogen they are attached to may represent an N-heterocycle; and $R_7$=an amidoamine moiety of the formula:

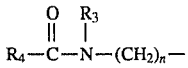

wherein n=2 to 6;

$R_3$=hydrogen or alkyl, hydroxyalkyl or alkenyl of up to 6 carbons; or cycloalkyl of up to 6 carbon atoms, or polyoxyalkylene of up to 10 carbon atoms; and $R_4$=alkyl, alkenyl, alkoxy or hydroxyalkyl, $C_5$–$C_{21}$, or aryl or alkaryl of up to $C_{20}$;

and

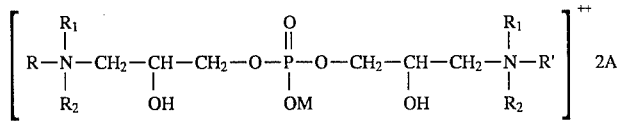

wherein

A=an anion;

M=a cation;

R, $R_1$ & $R_2$ can be the same or different, are alkyl, substituted alkyl, alkyl aryl or altkenyl groups of up to 16 carbon atoms, and the total carbon atoms of $R+R_1+R_2$=10 to 24; and R' is an amidoamine moiety of the structure:

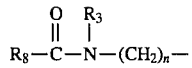

wherein n=2 to 6;

$R_3$=hydrogen or alkyl, hydroxyalkyl or alkenyl of up to 6 carbons; or cycloalkyl of up to 6 carbon atoms, or polyoxyalkylene of up to 10 carbon atoms; and $R_8$ has the following structure:

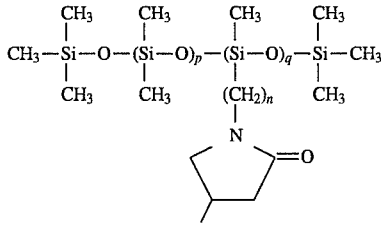

wherein n=3 or greater;

p=1 to 1000;

q=1 to 25.

Suitable silicone quaternaries include, without limitation, those having the following structure:

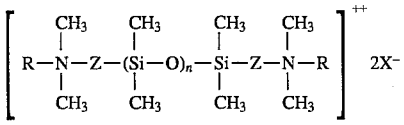

wherein

R=alkyl group, $C_{12}$–$C_{18}$;

Z=—$CH_2$—$CH_2$—$CH_2$—O—$(CH_2)_3$—;

X=alkoxy, chloride or other compatible counterion; and n=1 to 50.

Suitable organoreactive polysiloxanes include, without limitation, those having the following structures:

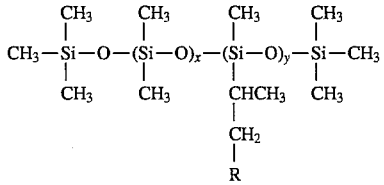

and

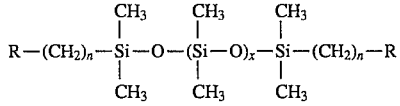

and

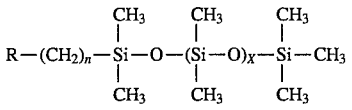

wherein

R=amine, carboxy, hydroxy, or epoxy;

n=3 or greater;

x=1 to 1000; and y=1 to 25.

EXAMPLES

Example 1

A one-ply, uncreped, through-air-dried tissue was made using a layered headbox. The two outer layers contained bleached eucalyptus hardwood kraft pulp processed through a Maule shaft disperser with a power input of 80 kilowatts at a consistency of about 34 percent and at a temperature of about 184° F. The two outer layers made up 70 percent of the tissue sheet by weight of the fiber. The remaining 30 percent of the tissue sheet constituted the inner layer consisting of northern softwood kraft pulp. The total basis weight of the sheet was 33.9 grams per square meter of air dried tissue. The inner layer was refined to obtain sufficient dry strength in the final product. A wet strength agent, Parez 631NC (glyoxalated polyacrylamide obtained from Cytec Industries, Inc.) was metered into the inner layer at a rate of 5 kilograms active matter per tonne of fiber. An aqueous softener blend comprising 4 weight percent of a quaternary ammonium compound (methyl-1-oleyl amidoethyl-2-oleyl imidazolinium methylsulfate) (Varisoft 3690 from Witco Corporation, 90 percent active matter) and 1 weight percent silicone glycol (silicone polyether identified as Dow Corning 190 from Dow Corning Corporation) was premixed and added to the outer layers at the thick stock (2 percent consistency). The thick stock of all layers was diluted to approximately 0.12 percent consistency prior to formation of the tissue web. The resulting furnish contained 5.25 kilograms per tonne of Varisoft 3690 (0.525 dry weight percent) and 1.32 kilograms per tonne of Dow Corning 190 (0.132 dry weight percent). The resulting tissue was softer to the touch than similar tissue made with the quaternary compound but without the silicone glycol.

Example 2

A two-ply, uncreped, through-air-dried tissue was made using a layered headbox. Each ply contained three layers. Two layers contained dispersed bleached eucalyptus hardwood kraft pulp and made up 58 percent of the tissue web by weight of fiber. The remaining 42 percent of the tissue web, consisting of bleached northern softwood kraft pulp, was formed on top of the two eucalyptus layers. The basis weight of each ply was 15.25 grams per square meter of air-dried tissue. The softwood layer was refined to obtain sufficient dry strength in the final product. A wet strength agent, Parez 631NC, was metered into the softwood layer at a rate of 5 kilograms of active matter per tonne of fiber. An aqueous softener blend comprising 4 weight percent of a quaternary ammonium compound (Varisoft 3690) and 1 weight percent silicone glycol (Dow Corning 190) was pre-mixed and added to both eucalyptus layers at the thick stock (2 percent consistency). The thick stock of all layers was diluted to approximately 0.10 percent consistency prior to forming the tissue web. The resulting furnish contained 4.35 kilograms per tonne of Varisoft 3690 (0.435 dry weight percent) and 1.09 kilograms per tonne of Dow Corning 190 (0.109 dry weight percent). The dried tissue webs were plied together in such a way so that the eucalyptus furnish was on the outside. The resulting tissue was softer to the touch than similar tissue made with the quaternary compound without silicone glycol.

Example 3

A layered, one-ply, creped, through-air-dried tissue was made using a three-layered headbox. The first stock layer (which was positioned against the Yankee dryer during drying) and third stock layer were the two outer layers and contained bleached southern hardwood kraft and bleached eucalyptus hardwood kraft pulp, respectively. The second stock layer, which was the inner layer, consisted of bleached northern softwood kraft pulp and broke. The two outer layers each made up 25 percent of the tissue web by weight. The inner layer constituted the remaining 50 percent of the tissue sheet. The total basis weight of the tissue web was 28.0 grams per square meter of air dried tissue. A wet strength agent (Parez 631NC) was metered into the inner layer at the rate of 1.24 kilograms of active matter per tonne of fiber. Redi-Bond 2005 starch (obtained from National Starch and Chemical Company) was also added to the same layer at a rate of 13 kilograms of active matter per tonne of fiber to deliver adequate dry strength. The same softening blend as described in Examples 1 and 2 was pre-mixed and added to the eucalyptus layer via the thick stock (2 percent consistency). The thick stock of all layers was diluted to 0.12 percent consistency prior to forming the tissue web. The resulting furnish contained 1.79 kilograms per tonne of fiber of Varisoft 3690 (0.179 dry weight percent) and 0.45 kilograms per tonne of fiber of Dow Corning 190 (0.045 dry weight percent). The resulting tissue had a soft, silky feel.

Example 4

A two-ply soft tissue was made by combining two wet-pressed, creped basesheets produced with two layers using a layered headbox. The first stock layer contained eucalyptus hardwood fiber and made up 60 percent of the tissue sheet by weight of the fiber. The remaining 40 percent of the tissue sheet was provided via a second stock layer consisting of northern softwood kraft pulp. The total basis weight per ply of creped tissue was 15.2 grams per square meter air-dried. Two strength agents were used: Kymene 557 LX (Hercules, Inc.) and Parez 631NC. Kymene 557 LX was blended into the softwood layer at the ratio of 0.19 percent active matter by weight of fiber and into the hardwood layer at the ratio of 0.05 percent active matter by the weight of the fiber. Parez 631NC was metered into the softwood layer at the ratio of 0.47 percent active matter by weight of the fiber. A blend of 10 weight percent silicone glycol (Dow Corning 190) and 90 weight percent organoreactive polysiloxane softener/debonder (methylaminopropyl siloxane, hydroxy-terminated, 20 percent active, identified as Dow Corning 2-8676 emulsion) was prepared and diluted with water to a final concentration of 10 weight percent of Dow Corning 2-8676 and 1.11 weight percent of Dow Corning 190. The diluted mixture was metered into the hardwood thick stock (2 percent consistency) so that the final furnish contained 0.05 dry weight percent active matter of Dow Corning 2-8676 and 0.01 dry weight percent active matter of Dow Corning 190. The resulting tissue was softer and slicker to the touch than similar tissue produced with the polysiloxane softener/debonder but without the silicone glycol.

Example 5

A tissue was made using the same basesheet as in Example 4, except the blend of silicone glycol and softener/debonder consisted of 90 weight percent of an organoreactive polysiloxane (aminoethylaminopropyl dimethyl siloxane, identified as Dow Corning 108) and 10 weight percent of Dow Corning 190 (silicone glycol). The mixture was metered into the hardwood thick stock (2 percent consistency) to produce furnish containing 0.1 dry weight percent active matter of Dow Corning 108 and 0.01 dry weight percent active matter of Dow Corning 190. The resulting tissue was softer and slicker (less abrasive) to the touch than tissue made with the polysiloxane softener/debonder but without the silicone glycol.

Example 6

A soft two-ply, wet-pressed creped tissue was made using a layered headbox. The first stock layer contained eucalyptus hardwood fiber and made up 60 percent of the tissue sheet by weight of the fiber. The remaining 40 percent of the tissue sheet was provided via a second stock layer consisting of northern softwood kraft pulp. The basis weight of the sheet was 15.2 grams per square meter of air-dried tissue. Kymene 557 LX was used as the strength agent and was blended into the softwood layer at the ratio of 0.23 percent active matter by the weight of the fiber. The blend of silicone glycol and softener/debonder comprised 4.5 weight percent active matter of Varisoft 3690 (quaternary ammonium compound), 1.05 weight percent of Dow Corning 190 (silicone glycol) and 94.95 weight percent of water. The blend was added at the hardwood thick stock (2 percent consistency) to produce a tissue furnish containing about 0.1 to 0.2 dry weight percent of Varisoft 3690 and about 0.02 to 0.04 dry weight percent of Dow Corning 190. The resulting tissue was softer and slicker to the touch compared to similar tissue made with the quaternary compound but without the silicone glycol.

Example 7

A tissue was made with the same basesheet as in Example 5, except the blend of silicone glycol and softener/debonder comprised 4.5 weight percent active matter of Varisoft 3690 (quaternary ammonium compound), 0.53 weight percent active matter of Dow Corning 2-8676 emulsion (organoreactive polysiloxane), and 0.53 weight percent active matter of Dow Corning 190 (silicone glycol). The blend was added at the thick stock of the conventional wet press tissue machine to make a furnish containing about 0.1 to 0.2 dry weight percent of Varisoft 3690 and about 0.01 to 0.02 dry weight percent each of the Dow Corning 2-8676 and Dow Corning 190. The resulting tissue was softer and slicker to the touch compared to similar tissue made with the quaternary compound and organoreactive polysiloxane but without the silicone glycol.

Example 8

A tissue was made using the same basesheet as in Example 5. The blend of the silicone glycol and the softener/debonder comprised 4.5 weight percent active matter of Varisoft 3690 (quaternary ammonium compound), 1.05 weight percent active matter of a silicone-modified phospholipid (Mona Industries, Inc., Code #54146, Lot 2426, 30 percent active), and 0.53 weight percent active matter of Dow Corning 190 (silicone glycol). The blend was added at the thick stock (2 percent consistency) of the conventional wet press tissue machine to make a tissue furnish containing about 0.1 to 0.2 dry weight percent of Varisoft 3690, about 0.02 to 0.04 dry weight percent of silicone-phospholipid and about 0.01 to 0.02 dry weight percent of Dow Corning 190, based on the weight of the fiber. The resulting tissue was softer and slicker to the touch than similar tissue made with the quaternary compound and silicone phospholipid but without silicone glycol.

It will be appreciated that the foregoing examples, given for purposes of illustration, are not to be construed as limiting the scope of this invention, which is defined by the following claims and all equivalents thereto.

We claim:

1. A soft tissue comprising papermaking fibers and from about 0.0001 to about 3 percent active matter, based on the weight of the fiber, of a silicone glycol and and from about 0.01 to about 6 percent active matter, based on the weight of fiber, of one or more softeners/debonders selected from the group consisting of quaternary ammonium compounds, quaternized protein compounds, phospholipids, silicone quaternaries and organoreactive polysiloxanes.

2. The tissue of claim 1 wherein at least one of the softener/debonders is a quaternary ammonium compound having the following structure:

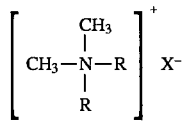

wherein

X=chloride, methyl sulfate, or other compatible counterion; and

R=aliphatic, saturated or unsaturated $C_8$–$C_{22}$.

3. The tissue of claim 1 wherein at least one of the softener/debonders is a quaternary ammonium compound having the following structure:

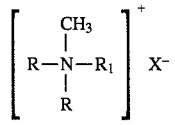

wherein

X=chloride, methyl sulfate, or other compatible counterion;

R=aliphatic, saturated or unsaturated $C_8$–$C_{22}$; and $R_1$=benzyl or epoxy group.

4. The tissue of claim 1 wherein at least one of the softener/debonders is a quaternary ammonium compound having the following structure:

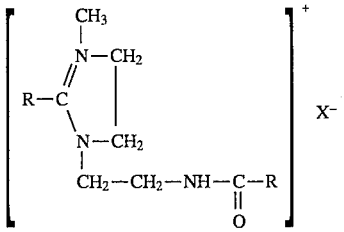

wherein

X=chloride, methyl sulfate, or other compatible counterion; and

R=aliphatic, saturated or unsaturated $C_8$–$C_{22}$.

5. The tissue of claim 1 wherein at least one of the softener/debonders is a quaternary ammonium compound having the following structure:

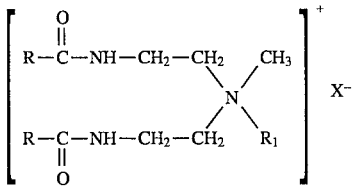

wherein

X=methyl sulfate, chloride, or other compatible counterion;

R=aliphatic, normal, saturated or unsaturated, $C_8$–$C_{22}$;

$R_1$=2-hydroxyethyl or 2-hydroxypropyl.

6. The tissue of claim 1 wherein at least one of the softener/debonders is a quaternary ammonium compound having the following structure:

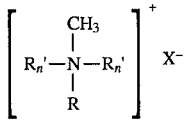

wherein

R=aliphatic, normal or branched, saturated or unsaturated, $C_8$–$C_{22}$;

X=chloride, methyl sulfate, ethyl sulfate, or other compatible counterion;

R'=2-hydroxyethyl or polyethoxyethanol; and n=1 to 50.

7. The tissue of claim 1 wherein at least one of the softener/debonders is a quaternary ammonium compound having the following structure:

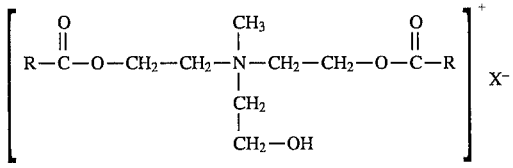

wherein

R=$C_8$–$C_{22}$; and

X=methyl sulfate, chloride, or other compatible counterion.

8. The tissue of claim 1 wherein at least one of the softener/debonders is a quaternary ammonium compound having the following structure:

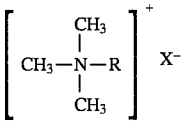

wherein

R=aliphatic, saturated or unsaturated, $C_8$–$C_{22}$; or allyl- or R'—O—$CH_2$—$CH_2$—$CH_2$— where R'=normal or branched, $C_4$–$C_{18}$; and X=chloride, sulfate or any other compatible counterion.

9. The tissue of claim 1 wherein at least one of the softener/debonders is a quaternary ammonium compound having the following structure:

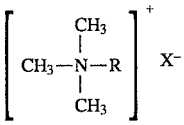

wherein

R=aliphatic alkyl, normal or branched, saturated or unsaturated, $C_8$–$C_{22}$; and X=chloride, methyl sulfate, or other compatible counterion.

10. The tissue of claim 1 wherein at least one of the softener/debonders is a quaternized protein compound having the following structure:

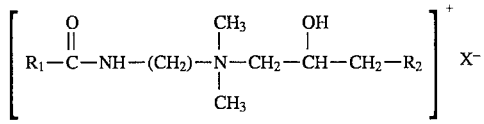

wherein $R_1$=fatty acid radical, saturated or unsaturated, $C_{12}$–$C_{22}$;

$R_2$=hydrolyzed soy protein, hydrolyzed silk protein, hydrolyzed wheat protein, collagen moiety, or keratin moiety; and X=chloride, lactate, or other compatible counterion.

11. The tissue of claim 1 wherein at least on of the softener/debonders is a quaternized protein compound having the following structure:

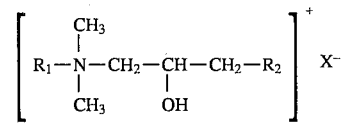

wherein $R_1$=fatty acid radical, saturated or unsaturated, $C_{12}$–$C_{22}$;

$R_2$=hydrolyzed collagen or keratin moiety; and

X=chloride, lactate, or other compatible counterion.

12. The tissue of claim 1 wherein at least one of the softener/debonders is a phospholipid having the following structure:

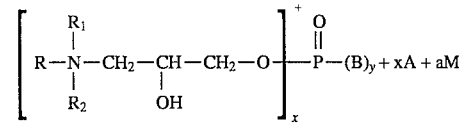

wherein x=1 to 3;

x+y=3;

a=0 to 2;

B=$O^{31}$ or OM;

A=an anion;

M=a cation; and

R, $R_1$ & $R_2$ can be the same or different, are alkyl, substituted alkyl, alkyl aryl or alkenyl groups of up to 16 carbon atoms and the total carbon atoms of $R+R_1+R_2$=10 to 24.

13. The tissue of claim 1 wherein at least one of the softener/debonders is a phospholipid having the following structure:

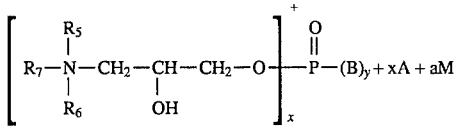

wherein x=1 to 3;

x+y=3;

a=0 to 2;

B=$O^{31}$ or OM;

A=an anion;

M=a cation;

$R_5$, $R_6$ may be the same or different, are alkyl, hydroxyalkyl, carboxyalkyl of up to $C_6$, or polyoxyalkylene of up to $C_{10}$; or $R_5$, $R_6$ and the nitrogen they are attached to may represent an N-heterocycle; and $R_7$=an amidoamine moiety of the formula:

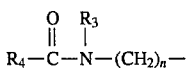

wherein n=2 to 6;

$R_3$=hydrogen or alkyl, hydroxyalkyl or alkenyl of up to 6 carbons; or cycloalkyl of up to 6 carbon atoms, or polyoxyalkylene of up to 10 carbon atoms; and $R_4$=alkyl, alkenyl, alkoxy or hydroxyalkyl, $C_5$–$C_{21}$, or aryl or alkaryl of up to $C_{20}$.

14. The tissue of claim 1 wherein at least one of the softener/debonders is a phospholipid having the following structure:

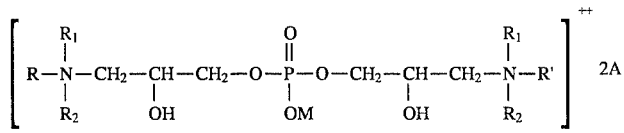

wherein

A=an anion;

M=a cation;

R, $R_1$ & $R_2$ can be the same or different, are alkyl, substituted alkyl, alkyl aryl or altkenyl groups of up to 16 carbon atoms, and the total carbon atoms of $R+R_1+R_2$=10 to 24; and R' is an amidoamine moiety of the structure:

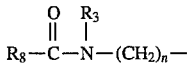

wherein n=2 to 6;

$R_3$=hydrogen or alkyl, hydroxyalkyl or alkenyl of up to 6 carbons; or cycloalkyl of up to 6 carbon atoms, or polyoxyalkylene of up to 10 carbon atoms; and $R_8$ has the following structure:

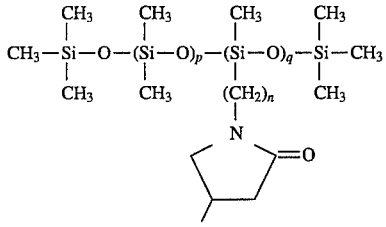

wherein n=3 or greater;

p=1 to 1000; and q=1 to 25.

15. The tissue of claim 1 wherein at least one of the softener/debonders is a silicone quaternary having the following structure:

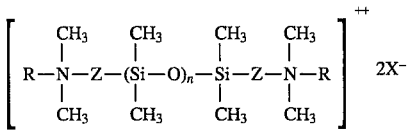

wherein

R=alkyl group, $C_{12}$–$C_{18}$;

Z=—$CH_2$—$CH_2$—$CH_2$—O—$(CH_2)_3$—;

X=alkoxy, chloride or other compatible counterion; and n=1 to 50.

16. The tissue of claim 1 wherein at least one of the softener/debonders is an organoreactive polysiloxane having the following structure:

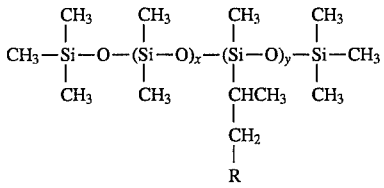

wherein

R=amine, carboxy, hydroxy, or epoxy;

n=3 or greater;

x=1 to 1000; and y=1 to 25.

17. The tissue of claim 1 wherein at least one of the softener/debonders is an organoreactive polysiloxane having the following structure:

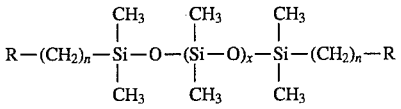

wherein

R=amine, carboxy, hydroxy, or epoxy;

n=3 or greater;

x=1 to 1000; and y=1 to 25.

18. The tissue of claim 1 wherein at least one of the softener/debonders is an organoreactive polysiloxane having the following structure:

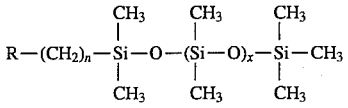

wherein

R=amine, carboxy, hydroxy, or epoxy;

n=3 or greater;

x=1 to 1000; and y=1 to 25.

19. The tissue of claim 1 wherein the silicone glycol has the following structure:

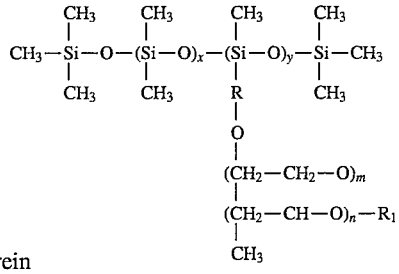

wherein

R=alkyl group, $C_1$–$C_6$;

$R_1$=acetate or hydroxyl group;

x=1 to 1000;

y=1 to 50;

m=1 to 30; and n=1 to 30.

20. A method for making a soft tissue comprising: (a) adding one or more softener/debonders and a silicone glycol to an aqueous suspension of papermaking fibers, either separately or as a combined aqueous mixture, wherein the amount of softener/debonder is from about 0.01 to about 6 percent active matter, based on the weight of fiber, and wherein the amount of silicone glycol is from about 0.0001 to about 3 percent active matter, based on the weight of fiber; (b) depositing the aqueous suspension of papermaking fibers onto a forming fabric to form a tissue web; and (c) dewatering and drying the web.

* * * * *